US011913145B2

(12) United States Patent
Laukamp et al.

(10) Patent No.: US 11,913,145 B2
(45) Date of Patent: Feb. 27, 2024

(54) LOOM AND METHOD FOR GUIDING A WOVEN FABRIC IN A LOOM

(71) Applicant: Lindauer DORNIER Gesellschaft mit beschraenkter Haftung, Lindau (DE)

(72) Inventors: Thomas Laukamp, Lindau (DE); Nicolas Mega, Opfenbach (DE); Dirk Janicijevic, Lindau (DE)

(73) Assignee: LINDAUER DORNIER GESELLSCHAFT MIT BESCHRAENKTER HAFTUNG, Lindau (DE)

( * ) Notice: Subject to any disclaimer, the term of this patent is extended or adjusted under 35 U.S.C. 154(b) by 270 days.

(21) Appl. No.: 17/253,353

(22) PCT Filed: Jul. 11, 2019

(86) PCT No.: PCT/EP2019/068650
§ 371 (c)(1),
(2) Date: Dec. 17, 2020

(87) PCT Pub. No.: WO2020/011908
PCT Pub. Date: Jan. 16, 2020

(65) Prior Publication Data

US 2021/0262127 A1 Aug. 26, 2021

(30) Foreign Application Priority Data

Jul. 11, 2018 (DE) ..... 10 2018 211 531.1

(51) Int. Cl.
*D03J 1/00* (2006.01)
*D03J 1/22* (2006.01)
(Continued)

(52) U.S. Cl.
CPC ..... *D03J 1/223* (2013.01); *D03D 47/12* (2013.01)

(58) Field of Classification Search
CPC ..... D03J 1/223; D03D 47/12; D03D 39/00
See application file for complete search history.

(56) References Cited

U.S. PATENT DOCUMENTS 2,052,493 A 8/1936 Simmons
4,117,870 A * 10/1978 Gotoh ..... D03D 51/34 139/370.2
(Continued)

FOREIGN PATENT DOCUMENTS

DE 33 33 426 4/1985
DE 03333426 A 4/1985
(Continued)

OTHER PUBLICATIONS

English translation of the International Search Report of the International Searching Authority for International Application PCT/EP2019/068650, dated Nov. 22, 2019, 4 pages, European Patent Office, HV Rijswijk, Netherlands.
(Continued)

*Primary Examiner* — Robert H Muromoto, Jr.
(74) *Attorney, Agent, or Firm* — Dority & Manning, P.A.

(57) ABSTRACT

A weaving machine includes a shed forming device, a weft insertion device, and a weaving reed that beats up the weft threads at a beat up plane against an edge of the woven fabric. A guide device extends over a width of the woven fabric and is driven by a drive, the guide device being one or both of an upper guide unit that contacts a top surface of the woven fabric or a lower guide unit that contacts a bottom surface of the woven fabric. A control unit controls alternating movement of the guide unit along the direction of thickness of the woven fabric as the fabric is being woven based on information related to one or both of a structure of the woven fabric in the area of the beat up plane or a position of the warp threads in the open loom shed.

16 Claims, 8 Drawing Sheets

Figure 1:
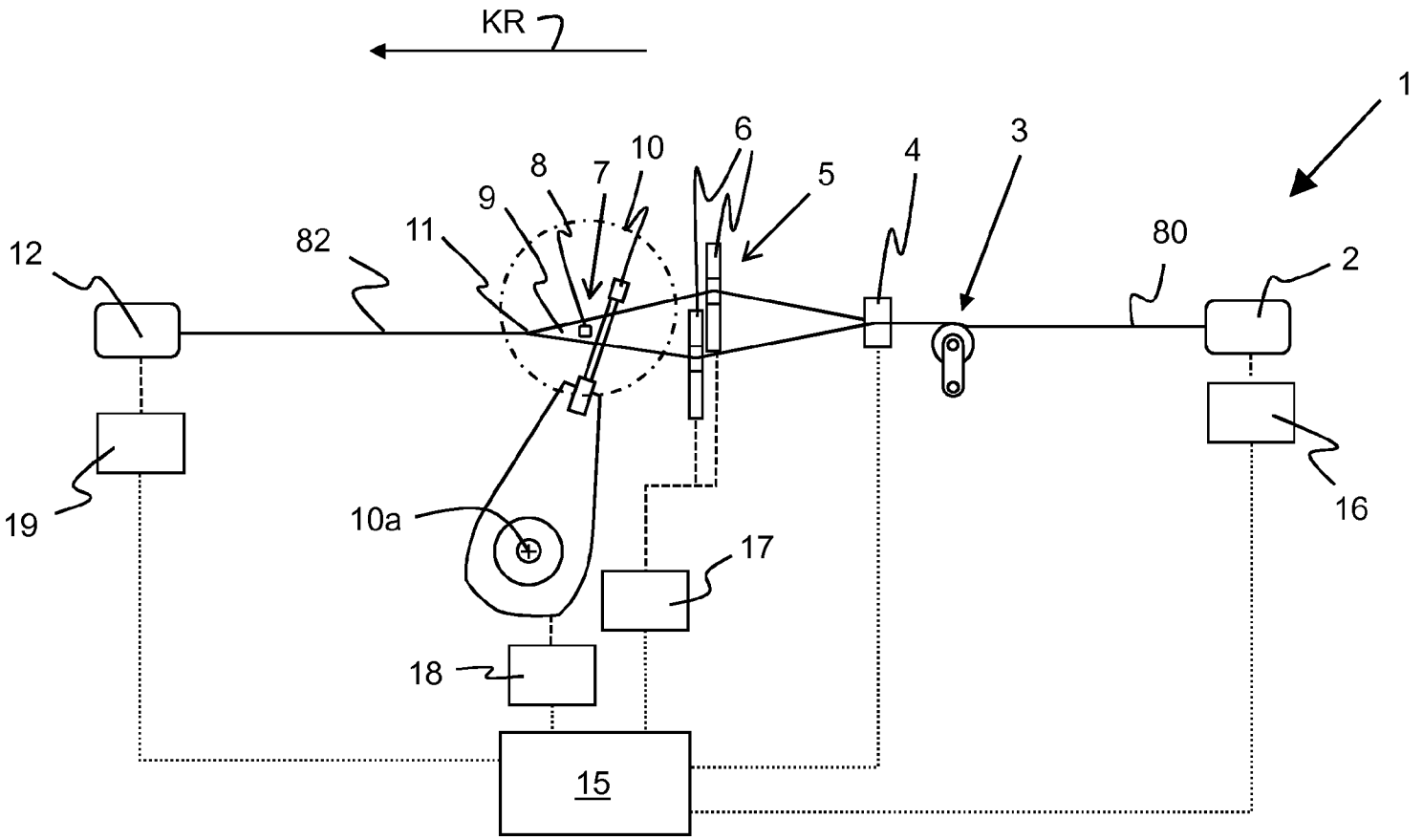

(51) Int. Cl.
*D03D 47/12* (2006.01)
*D03D 47/27* (2006.01)

(56) References Cited

U.S. PATENT DOCUMENTS

| | | | | |
|---|---|---|---|---|
| 4,892,120 | A | 1/1990 | Bostyn | |
| 5,507,481 | A * | 4/1996 | Meyer | B65H 9/00 271/189 |
| 7,644,737 | B2 * | 1/2010 | Mueller | D03D 35/00 139/21 |
| 2008/0230138 | A1 * | 9/2008 | Mueller | D03D 35/00 139/22 |
| 2016/0161301 | A1 * | 6/2016 | Guenther | G09B 19/00 702/150 |

FOREIGN PATENT DOCUMENTS

| | | |
|---|---|---|
| DE | 38 76 856 | 4/1993 |
| EP | 0 316 575 | 5/1989 |
| FR | 3 074 195 | 5/2019 |
| JP | 2006-508272 A | 3/2006 |
| JP | 2006-089857 A | 4/2006 |
| JP | 2008-527194 A | 7/2008 |
| JP | 2009-507138 A | 2/2009 |
| JP | 2014-507571 A | 3/2014 |
| JP | 2016-528400 A | 9/2016 |
| JP | 2016-191158 A | 11/2016 |
| WO | WO 2016/142899 | 9/2016 |

OTHER PUBLICATIONS

PCT International Preliminary Report on Patentability including English Translation of PCT Written Opinion of the International Searching Authority for International Application PCT/EP2019/068650, dated Jan. 12, 2021, 13 pages, International Bureau of WIPO, Geneva, Switzerland.

German Office Action dated Oct. 18, 2019 in German Patent Application No. 10 2018 211 531.1, 4 pages, with English partial translation, 1 page.

JP Office Action with Translation, dated Oct. 20, 2023.

* cited by examiner

LOOM AND METHOD FOR GUIDING A WOVEN FABRIC IN A LOOM

The invention relates to a weaving machine or loom according to the preamble of the independent claims. Similarly the invention relates to corresponding methods.

Such weaving machines or looms have long been known, for example in the form of gripper or rapier weaving machines and air jet weaving machines. It is common to these, that a plurality of warp threads running next to one another in the production direction are lifted up and lowered down by means of a shed forming device, in order to form an open shed, through which (at least) one weft thread is inserted. Thereafter the shed is again closed, the weft thread is beat-up by a weaving reed against the interlacing point, in order to then again open the shed. The woven fabric is successively drawn off by a drawing-off or take-off device and is, for example, rolled up on a cloth beam or is removed from the weaving machine in a horizontal condition.

It is disadvantageous in the known weaving machines, that a secure or reliable weaving process cannot always be ensured, especially for woven fabrics that deviate from the typical geometry, especially for woven fabrics with a greater thickness and/or an uneven surface character.

It is the object of the present invention to achieve an improved woven fabric control or woven fabric guidance.

This object is achieved by the features of the independent claims.

The advantages of the invention especially exist in that means and methods are provided, which make possible a guidance of the woven fabric in the area of the weaving reed beat-up plane, which guidance is more precise and utilizable under many weaving conditions. The term of the area of the weaving reed beat-up plane is herein understood to mean that area of the woven fabric that lies in the immediate vicinity or direct proximity of the weaving reed beat-up, namely in the range of a few millimeters (down to 0 mm) to several centimeters from the weaving reed beat-up plane in the direction of the woven fabric that has already been produced.

According to a first aspect of the invention, a weaving machine comprises at least one guide device, which comprises at least one guide unit that extends at least partially over the woven fabric width. This at least one guide unit encompasses respectively at least one guide section that can be positioned essentially in the woven fabric thickness direction, with which the woven fabric is guidable in a contacting manner in the area of the weaving reed beat-up plane, that is to say the guide section lies in contact against the woven fabric and guides it. In this regard, at least one upper guide unit for guiding the woven fabric on its top surface and/or at least one lower guide unit for guiding the woven fabric on its bottom surface are provided. Moreover, a control unit is provided, that is configured for controlling at least one drive. This at least one drive is connected with the at least one guide unit, in order to change the position of at least one of its guide sections essentially in the woven fabric thickness direction. In this regard, for the purpose of the stated control according to a preferred variant, the stated control unit processes informations that are related to the woven fabric structure in the area of the weaving reed beat-up plane.

In this aspect of the invention, the woven fabric structure in the area of the weaving reed beat-up plane prescribes how the woven fabric is guided in this area, namely in the area of the weaving reed beat-up plane in the woven fabric thickness direction, that is to say generally perpendicularly to the woven fabric surface. In this regard, the term of the woven fabric structure encompasses the inner or internal woven fabric structure, that is to say the course or pattern of the warp threads and the weft threads in the woven fabric dependent on the pattern draft, the thickness of the woven fabric in the area of the weaving reed beat-up plane and/or the surface characteristic on the bottom and/or top surface of the woven fabric in the area of the weaving reed beat-up plane, including the respective fluctuations in the thickness or of the surface characteristic in the warp direction and/or in the weft direction.

For example, an optimal guidance can be achieved for woven fabrics that comprise different thicknesses in the weft direction and/or in the warp direction. With such "wandering" thicknesses of the woven fabric, a guidance of the woven fabric according to the invention prevents warp threads from being lifted up away from the woven fabric by the heddles in the area of the weaving reed beat-up plane during the opening of the loom shed, or even that the entire woven fabric is moved out of the weaving plane.

Under the term of the at least one guide unit that extends at least partially over the woven fabric width, it is to be understood that the woven fabric in the area of the weaving reed beat-up plane is guided over at least one section in the weft direction, that is to say in the woven fabric width. In this regard, also several guide units that extend in the weft direction next to one another can be provided, whereby the end faces of two adjacent guide units, for example, can be arranged in immediate or direct proximity to one another or with a spacing distance relative to one another. In principle, in this regard the most varied embodiments are possible, as long as a guidance over at least a section and preferably over the entire width of the woven fabric is realized.

The term "informations that are related to the woven fabric structure in the area of the weaving reed beat-up plane", is to be understood to include especially such informations that are directly derivable from the woven fabric structure, but also such informations that are adapted or coordinated with the woven fabric structure, or in which the fabric structure is taken into consideration. In the following, advantageous corresponding examples are identified.

Especially preferably, the control unit receives the stated informations that are related to the woven fabric structure from one or more of the following listed sources. According to a preferred embodiment corresponding thereto, the woven fabric guidance is achieved in a pattern-controlled manner. For this, the stated informations are directly or indirectly stored, for example in a pattern draft, that is to say in the electronically stored woven fabric pattern, whereby the control unit accesses these informations. For storing directly in the pattern draft, the pattern designer must introduce these informations during the programming thereof. For this, he uses, for example, specialized tracks present in the pattern draft, by means of which (e.g. in a bit pattern encoded manner) informations for positioning the at least one guide unit can be stored. These informations are interpreted by the weaving machine directly for positioning the at least one guide unit without further additional information.

In connection with an indirect storing of the informations in the sense of the selection of informations for positioning the at least one guide unit, for example indices can be defined in specialized tracks of the pattern draft, for example by the programmer or the weaving machine operator, whereby the indices refer to a different source with corresponding informations, which are stored in a different location of the weaving machine or outside of the weaving machine, for example in a central control of the weaving mill. These informations are, for example the positions to which the at least one guide unit shall move in the woven fabric thickness direction, which are then correspondingly processed by the control unit in order to correspondingly actuate the at least one guide unit.

According to an alternative, the control unit, independent of the pattern draft, accesses a storage unit in which the corresponding informations are stored. Such an access by the control unit takes place in time proximity, preferably at the same time, as the reading-out of the actual pattern informations in the pattern draft, so that the woven web guidance is temporally coordinated to the woven fabric pattern.

The described direct an indirect storing of informations in a pattern draft or in a separate storage unit are examples for informations that are related to the woven fabric structure. In these cases, there is no immediate or direct relationship between the woven fabric structure and the informations that are processed by the control unit, but rather an intervening or indirect one. The stated informations are namely coordinated with the woven fabric structure or the woven fabric structure was taken into consideration when producing or establishing the informations, for example by the programmer or the operator of the weaving machine, in order to realize the desired or provided positioning of the at least one guide unit and therewith of the woven fabric in the area of the weaving reed beat-up plane.

In a further alternative, the control unit is configured so that an algorithm calculates the stated informations from the weaving pattern stored in the pattern draft. In this regard, no commands or instructions for the woven fabric guidance are programmed into the weaving pattern, as this is provided for the abovementioned case. Instead, the stated algorithm is capable of calculating, from the weaving pattern itself, the corresponding informations for actuating the at least one drive for the woven fabric guidance in the woven fabric thickness direction. Alternatively, already when establishing or setting up the pattern draft, the pattern designer uses the abovementioned algorithm so that the instructions to the control unit are already contained in the pattern draft that is made available to the weaving machine.

In all abovementioned cases, the pattern draft can be stored in the shed forming device, e.g. the control of a Jacquard device, or in a central control of the weaving machine or in a still further superordinated control, for example a central control of the weaving mill.

A further alternative provides that the informations for adjusting or setting the woven fabric guidance were not previously stored, but rather are determined during the weaving process. For this, one or more sensors, for example at least one optical sensor and/or at least one ultrasonic sensor, can be provided, which analyze the woven fabric surface—as a part of the woven fabric structure—in the area of the weaving reed beat-up plane, and provide the corresponding measured values to the control unit. From these, the control unit calculates the control commands or instructions for the woven fabric guidance. In this regard, the stated at least one sensor is arranged in front of the weaving reed beat-up plane, preferably on the end face of the weaving reed, and/or stationarily fixed between the guide device and the weaving reed and/or below the woven fabric in the area of the weaving reed beat-up plane and/or above the woven fabric in the area of the weaving reed beat-up plane.

The abovementioned sources from which the control unit receives the informations that are related to the woven fabric structure can be provided to the control unit as alternatives or in any desired combination.

Alternatively or in addition to the stated informations that are related to the woven fabric structure in the area of the weaving reed beat-up plane, the control unit processes informations regarding the position of the warp threads in the open loom shed, in order to then correspondingly actuate the at least one guide unit and to position it in the woven fabric thickness direction. Through the direct observation of the open loom shed, for example imminent collisions of the weft insertion means with the warp threads can be recognized and prevented through corresponding positioning of the at least one guide unit.

One embodiment of the invention correspondingly provides that one or more sensors for analyzing the position of the warp threads are provided in the open shed. The at least one corresponding sensor is embodied, for example, as an optical sensor, e.g. in the form of a camera. An embodiment is also possible in the form of several lasers, which are for example arranged above one another, and which send beams through the loom shed for example at different heights. The results of the analysis with regard to the shed are processed by the control unit for actuating the at least one stated drive, for example to shift the woven fabric in the woven fabric thickness direction, so that the weft pick can be inserted through the open shed without collision with the warp threads.

Particularly preferably, the control unit is able, based on the stated informations that are related to or connected with the woven fabric structure and/or relate to the position of the warp threads in the open loom shed, to actuate the at least one drive in such a manner so that the woven fabric as a whole is shifted in the woven fabric thickness direction in the area of the reed beat-up. Thereby it is possible to guide a weft insertion means for the weft thread to be inserted in a collision-free manner through the loom shed. In this regard, the weft insertion means is preferably embodied as a gripper (and the weaving machine thus as a gripper weaving machine). Especially for thick woven fabrics, for example with a thickness of more than 5 mm or more than 10 mm or more than 20 mm or more than 50 mm, due to the displacement of the woven fabric in the woven fabric direction, the weft insertion means can be moved through the loom shed for example with essentially equal spacing distance to the upper and lower warp threads that form the open loom shed. If e.g. a weft thread is inserted in the area of one woven fabric surface in a multilayered woven fabric, then the binding or interlacing edge, that is to say the woven edge as seen in section, against which the weaving reed beats-up, is shifted in the direction of this woven fabric surface relative to the neutral shed which extends through the middle or center plane of the woven fabric. In order that the weft insertion means can be moved in a collision-free manner through the open shed, the woven fabric in the area of the weaving reed beat-up plane is shifted, preferably as a whole, in the direction of the other surface of the woven fabric in its thickness direction.

Alternatively or additionally, the control unit is advantageously configured in such a manner so that it is able to actuate at least one of the guide units for guiding the woven fabric in its thickness direction. In this regard, a guidance without displacement of the woven fabric as a whole in its woven fabric thickness direction is also possible. For example, the woven fabric can be guided in a contacting manner on its top surface and/or bottom surface, also even with thickness fluctuations, without the neutral shed being displaced in the thickness direction.

According to a second aspect of the invention, a weaving machine according to the preamble of the independent apparatus claims comprises at least one guide device with at least two guide units that extend at least partially over the woven fabric width, which guide units comprise respectively at least one guide section that is positionable essentially in the woven fabric thickness direction for the contacting guidance of the woven fabric in the area of the weaving reed beat-up plane. In this regard, at least one upper guide unit for guiding the woven fabric on its top surface and at least one lower guide unit for guiding the woven fabric on its lower surface are provided. Furthermore, the stated at least two guide units are connected respectively with at least one drive, which are connected with a control unit so that they are movable both equi-directionally and counter-directionally in the woven fabric thickness direction.

With this embodiment of the weaving machine according to the second aspect of the invention, which can be combined with the features of the first aspect of the invention, a high flexibility or adaptability with respect to the woven fabric guidance is achieved. The woven fabric can be shifted with an equi-directional motion of the two guide units in the one or the other direction with respect to the woven fabric thickness; with a counter-directional motion the guide units can follow woven fabric thickness changes.

Independent of the aspect of the invention, according to an advantageous variant, the guide section or guide sections of only one lower or one upper guide unit are positionable in the woven fabric thickness direction only in one direction, while the other guide unit remains stationary. Hereby it is ensured that the corresponding guide section can also follow thickness variations only on one side or surface of the woven fabric.

Alternatively or additionally, the guide section or guide sections of only one guide unit are movable by means of a drive in one direction, while the guide section or guide sections of the other guide unit on the other side of the woven fabric are moved along with it in a merely passive manner, whereby this passive guide unit is impinged with a force, for example produced by a spring. Thus, in this embodiment in the simplest variant, only one single drive is necessary for the active movement of the at least one guide section. This configuration applies especially to embodiments according to the first aspect of the invention.

Various different configurations or embodiments of the at least one and preferably all of the guide units are possible independent of the aspect of the invention. In one embodiment, the at least one guide unit is embodied or configured as a rigid profile that extends in the weft direction. This can be positioned in the woven fabric thickness direction by the at least one drive. Alternatively, the at least one guide unit (or also several) is embodied as a passive or actively driven roller. With a passive roller, this can be brought into rotational motion by the woven fabric motion caused by the drawing-off or take-off device. With an actively driven roller, the circumferential speed thereof is preferably adapted to or coordinated with the drawing-off speed of the woven fabric. The same applies for the embodiment in which the at least one guide unit is embodied or configured as a circulating endless belt or band.

It has been determined to be advantageous that at least one of the stated lower and/or upper side guide units are provided in at least one and/or both of the following areas: for the purpose of a lateral guidance, that is to say a guidance of the woven fabric on at least one of its lengthwise edges extending in the warp direction (including of the so-called catch selvages that, if applicable, border on the actual main woven fabric), it is advantageous if such a lower and/or upper side guidance is present through one or more corresponding guide units. Alternatively or additionally it is preferred that the woven fabric is guided on the lower and/or upper side in the area adjoining at least one of the lengthwise edges in the direction of the woven fabric center or middle. It is possible, for example, that the two lengthwise edges are guided by other guide units than the woven fabric area or region lying therebetween (can also be designated as the main woven fabric). In a different embodiment, a lower and/or upper guide unit is provided for a lengthwise edge, while the main woven fabric and the other lengthwise edge are guided or moved with a common lower and/or upper guide unit. All of these measures overall improve the control over the woven fabric in the area of the weaving reed beat-up plane depending on the requirements.

The contact zone between at least one guide section of at least one guide unit—preferably of all guide sections of all guide units—preferably lies within a range from 0 to 100 mm, measured from the weaving reed beat-up plane, that is to say the weaving reed position at the time point of its beating against the woven fabric beat-up edge, in the woven fabric lengthwise direction. Preferably the contact region even lies between 0 and 50 mm.

Even if guide units for guiding the woven fabric from both sides in the woven fabric thickness direction are generally present, these guide units is or are positionable preferably in such a manner in the woven fabric thickness direction so that the woven fabric—temporarily or permanently—in the area of the weaving reed beat-up plane is guidable in a contacting manner only from its bottom surface, only from its top surface and/or from its bottom as well as the top surface of the woven fabric.

It can further be provided to advantage, that the upper and/or lower guide unit is movable away from the woven fabric and in this regard preferably also in the woven fabric thickness direction, to enable an easier access for an operator to weaving machine parts that are otherwise difficult to access, such as for example a harness. Such a motion of the guide unit(s) can be realized purely mechanically, for example by means of a lever mechanism, and/or by inputting a corresponding command or instruction to the control unit and then a corresponding actuation of one or more drives.

According to a third aspect of the invention according to the preamble of the independent apparatus claims, at least one guide device is provided with at least one guide unit which extends at least partially over the woven fabric width, and which comprises respectively at least one guide section for the contacting guidance of the woven fabric in the area of the weaving reed beat-up plane. Like in the first and second aspects of the invention, at least one upper guide unit for guiding the woven fabric on its top surface and/or at least one lower guide unit for guiding the woven fabric on its lower surface is provided. Moreover, one or more guide sections of at least one guide unit comprise overall a profiled shape in the weft direction. The term of the profiled shape herein is understood as a non-linear course or progression, in the weft direction, of the guide section or guide sections that contact the woven fabric of the at least one guide unit. Thereby, thickness variations of the woven fabric in the weft direction can be taken into consideration, without the guide section or guide sections losing the contact with the woven fabric along the weft direction.

The stated profiled shape can be realized in various different ways, in a very simple case for example as a through-going, that is to say continuous, non-linear profiled shape as seen in the weft direction, over a section of the woven fabric or over the entire woven fabric width. For example, the at least one guide unit is embodied rigidly or fixedly, and thus does not rotate about a rotation axis that extends e.g. in the weft direction. Especially woven fabrics with a thickness contour or progression that varies in the weft direction but remains constant in the warp direction can be guided advantageously in this manner.

According to an alternative the profiled shape is realized by individual actuators arranged behind one another in the weft direction, to which guide partial sections are respectively allocated, which overall or all together form a guide section. In this regard the individual actuators and thus also their guide partial sections are separately adjustable essentially in the woven fabric thickness direction. In this manner, through targeted actuation of the actuators, the woven fabric areas or regions coming into contact with these actuators can be guided in a defined manner. According to a further development of this alternative, the guide partial sections are preferably covered with a flexible sheath, which cover and bridge over the transitions between adjacent guide sections and thus contribute to a gentle or protective handling of the woven fabric.

In a further alternative, the profiled shape is realized by means of a through-going or continuous roller with a rotation axis extending essentially parallel to the weft direction. In this regard, the roller comprises a through-going or continuous profiled shape forming the guide section. A woven fabric with a thickness contour or progression that differs in the weft direction but is constant in the cross-section can be guided also by means of such a profiled shape, if the profiled shape is embodied symmetrically about the rotation axis extending in the weft direction.

Alternatively, a roller with such a rotation axis is provided, wherein the roller is divided into segments that are arranged one behind another in the weft direction. These segments comprise at least partially differing diameters and/or an arrangement eccentric to the rotation axis, in the manner of a cam shaft. By rotation of the roller in the production direction, areas or regions of the woven fabric lying next to one another in the weft direction can be guided at different heights on their bottom surface and/or top surface.

In still a further alternative, a roller is built up of individual segments arranged behind one another in the weft direction. In this regard, one or more of the individual segments are respectively rotatable about the longitudinal axis of the roller extending in the weft direction. It is also possible that several individual segments are respectively rotatable about an axis extending eccentrically to this longitudinal axis. Overall, such embodiments allow the most varied thickness changes of the woven fabric in the weft direction to be taken into consideration, whereby the woven fabric guidance remains reliably or securely ensured.

Through the described embodiments, not only can thickness changes of the woven fabric be taken into consideration, but also displacements or shifts of the interlacing point or binding edge in the woven fabric thickness direction can be evened-out or equalized, especially in order to be able to guide the gripper in a collision-free manner through the shed. For this purpose, the profiled shapes must be correspondingly matched or adapted to the pattern sequence of the woven fabric.

According to a preferred further development of the third aspect of the invention, at least one elastic element is arranged on at least one of the guide sections. Such an elastic element, which especially serves for the gentle or protective handling of the woven fabric, is, for example, embodied as a hose impinged with compressed air or is configured as a spring suspension. In this regard it is preferred that the at least one elastic element extends over the width of the woven fabric, in order to guide the woven fabric in the weft direction at each location.

Preferably at least one of the guide sections comprises a contour that extends with a curve or bend in the weft direction, in order to be able to guide, in the weft direction, a woven fabric that extends with a corresponding curve or bend.

The guide section or guide sections forming the profiled shape can be arranged stationary or positionable, preferably in that case in the woven fabric thickness direction. In the latter case, such a positionability can be realized, for example, manually or with the aid of a control unit and one or more correspondingly actuated drives, also e.g. in the scope of the first and/or second aspect of the invention.

The three abovementioned aspects of the invention may be advantageously combined with one another pairwise or all together.

The weaving machine according to the invention corresponding to the various aspects of the invention is especially preferably of the Jacquard type, so that an individual positioning of the individual heddles is made possible and also three-dimensional, that is to say relatively thick woven fabrics of high complexity can be woven.

Moreover, the woven fabric guidance and woven fabric shifting or displacement according to the invention, according to the various aspects of the invention can be combined with a height shifting or displacement of the gripper in the loom shed, which itself is known, in order to thereby further expand the application possibilities.

Moreover, the individual guide devices can be considered as separate inventions, thus as devices according to the invention is each taken by themselves, which are provided for installation in a weaving machine.

Similarly the invention relates to a method according to the independent method claims. The corresponding features and advantages have already been explained in connection with the apparatuses discussed further above.

Figure 3:
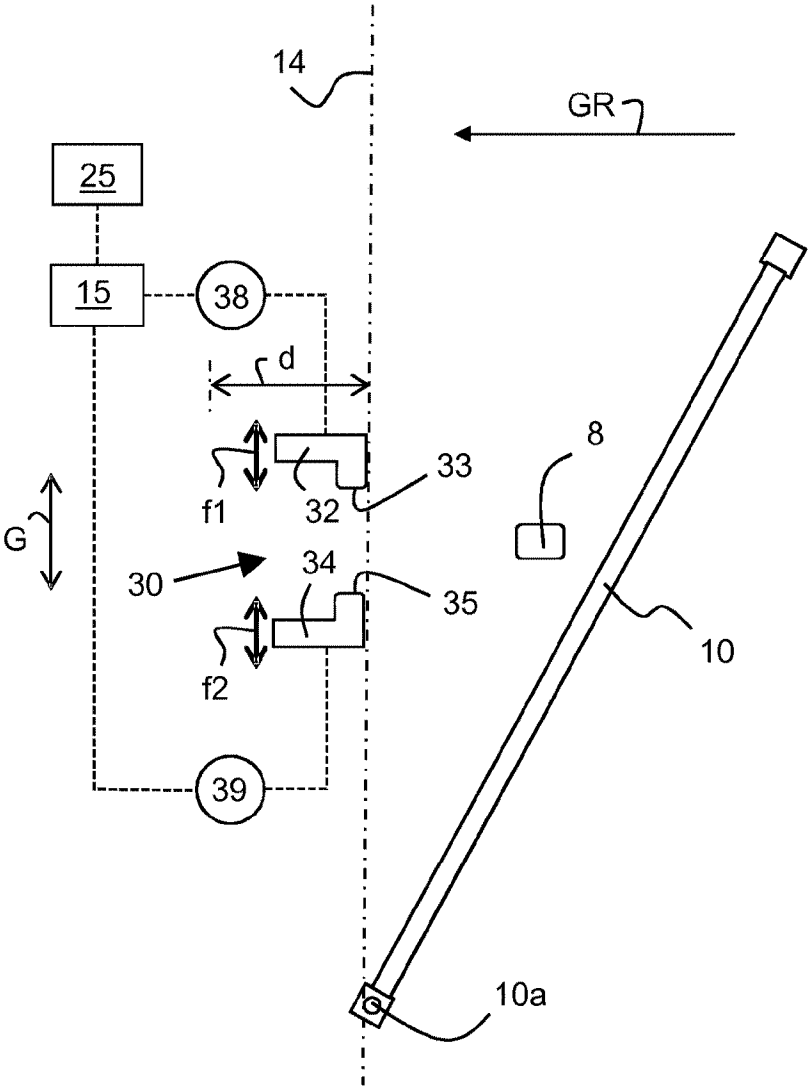
Figure 2:
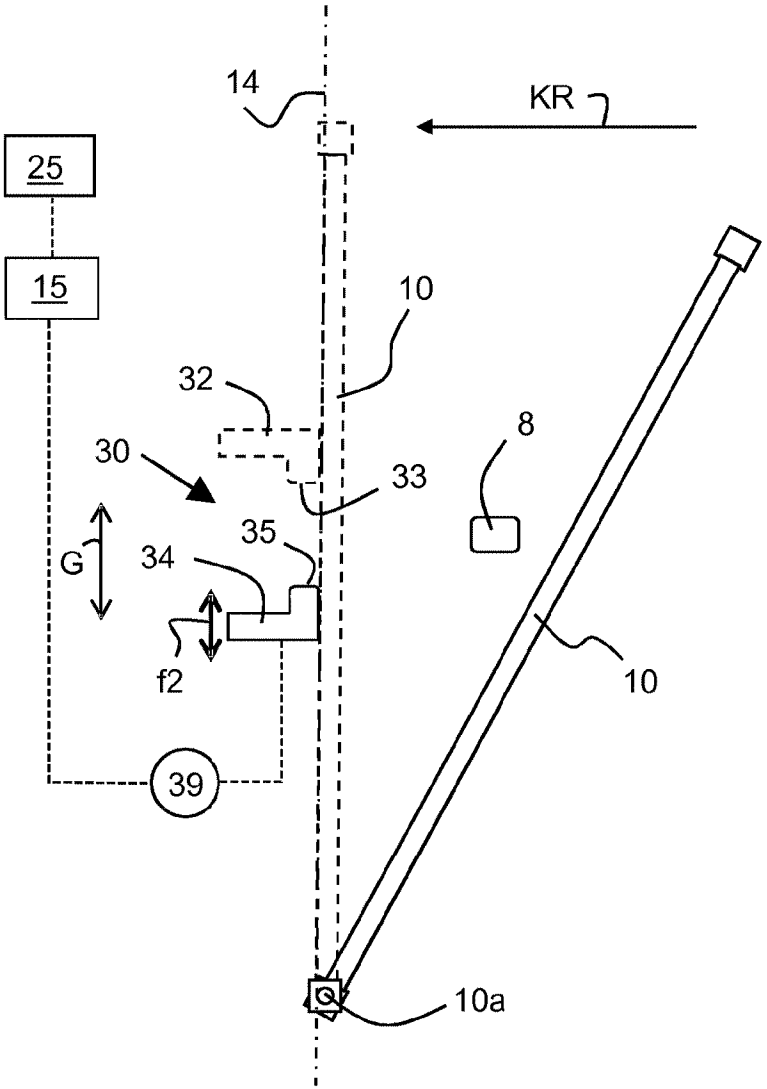
Figure 5:
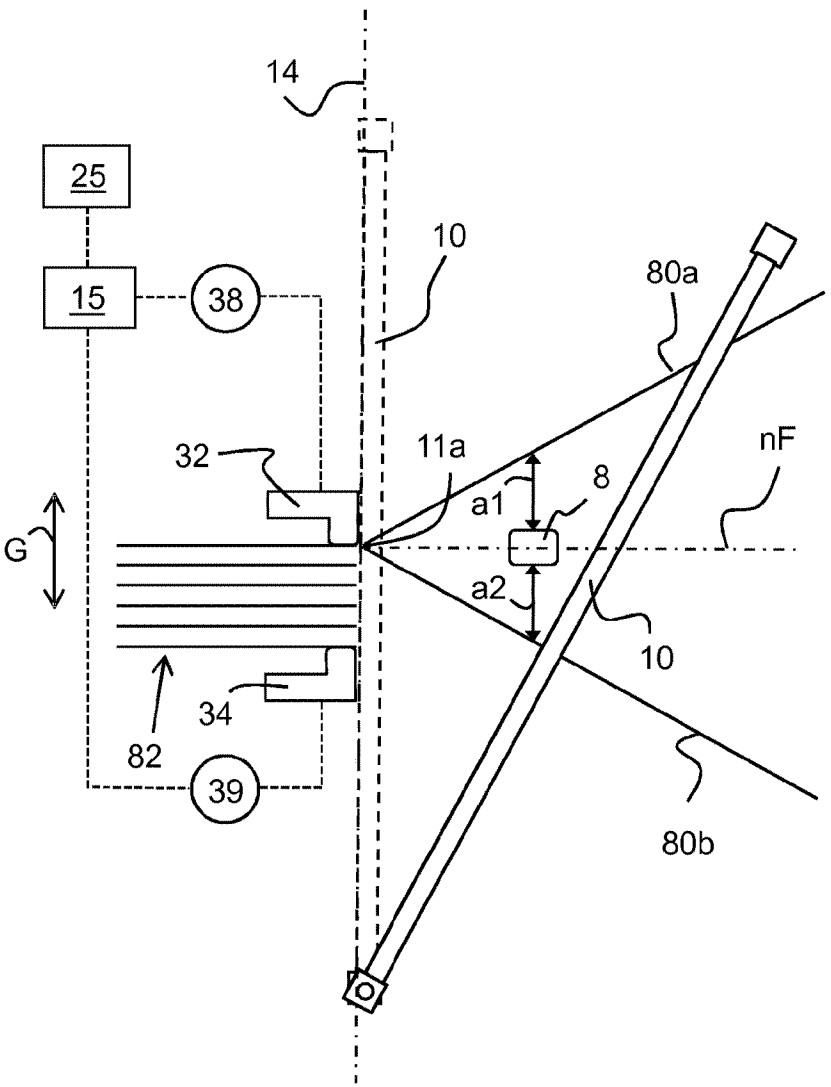
Figure 4:
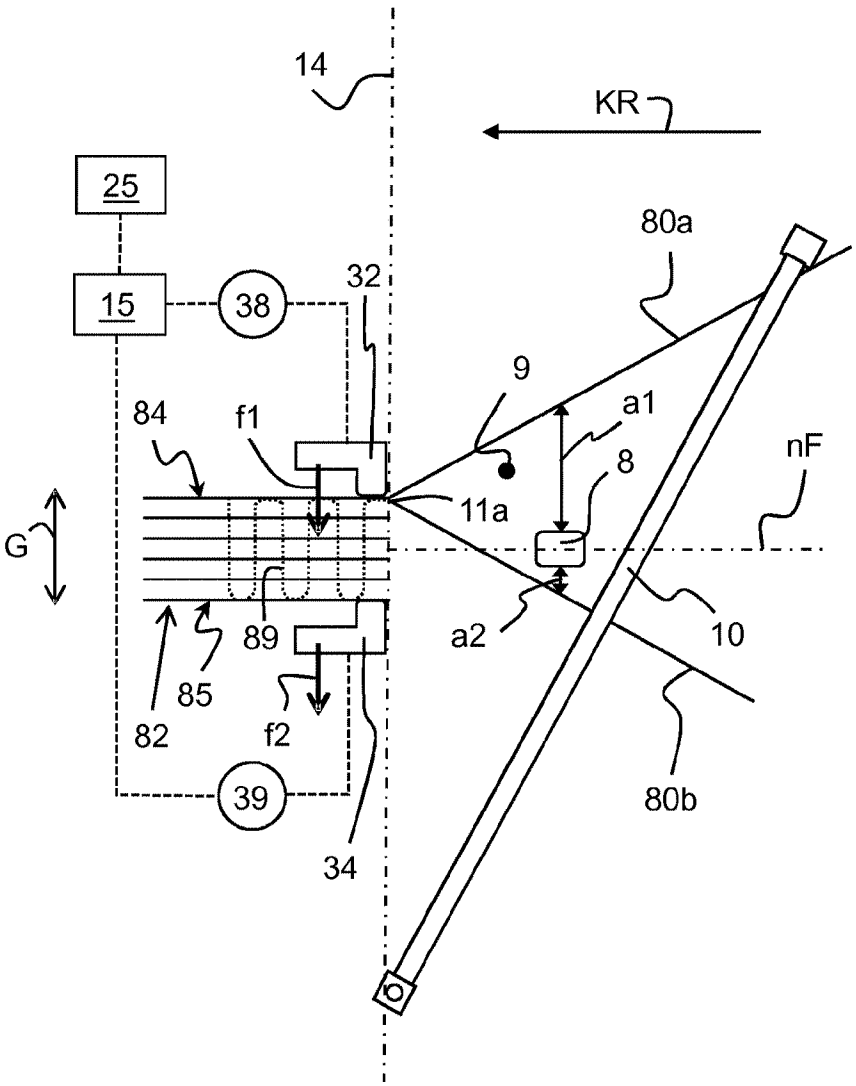
Figure 10:
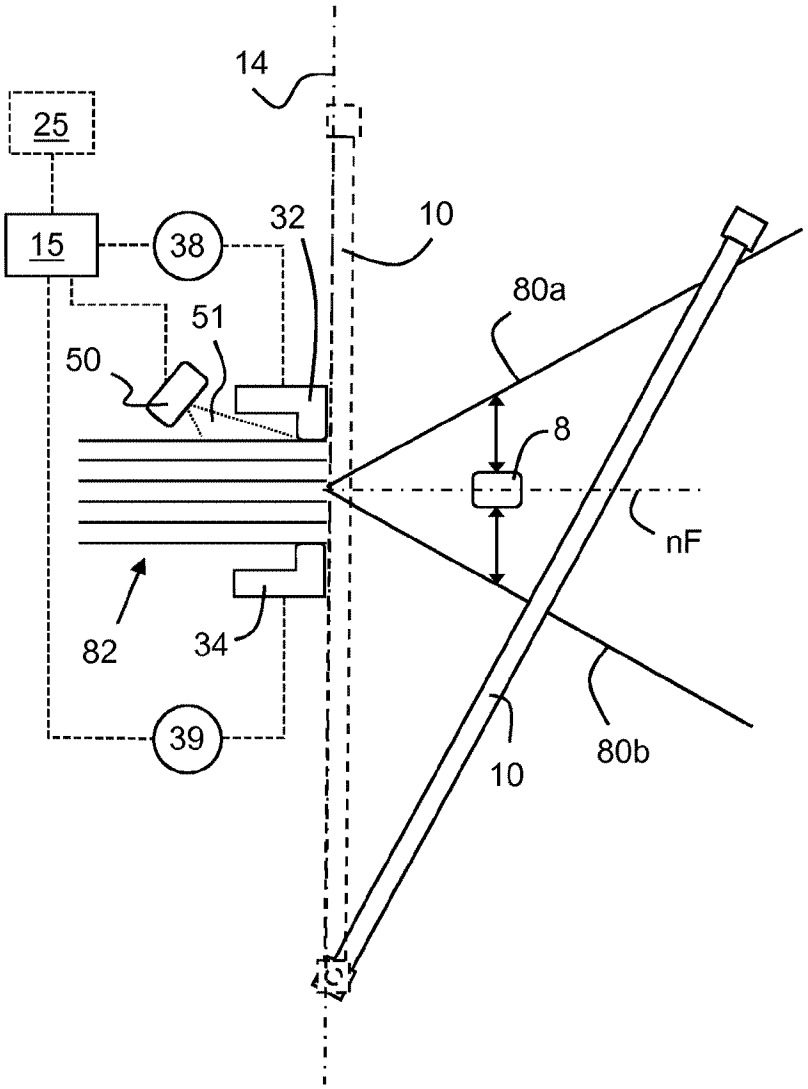
Figure 12:
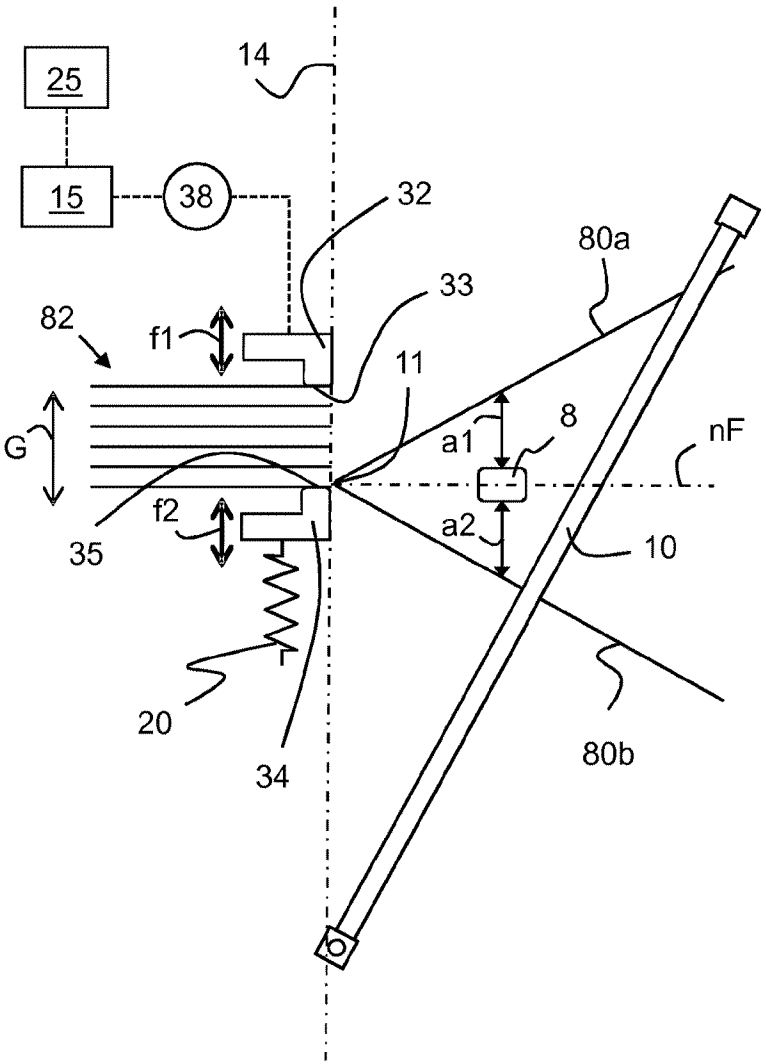
Figure 11:
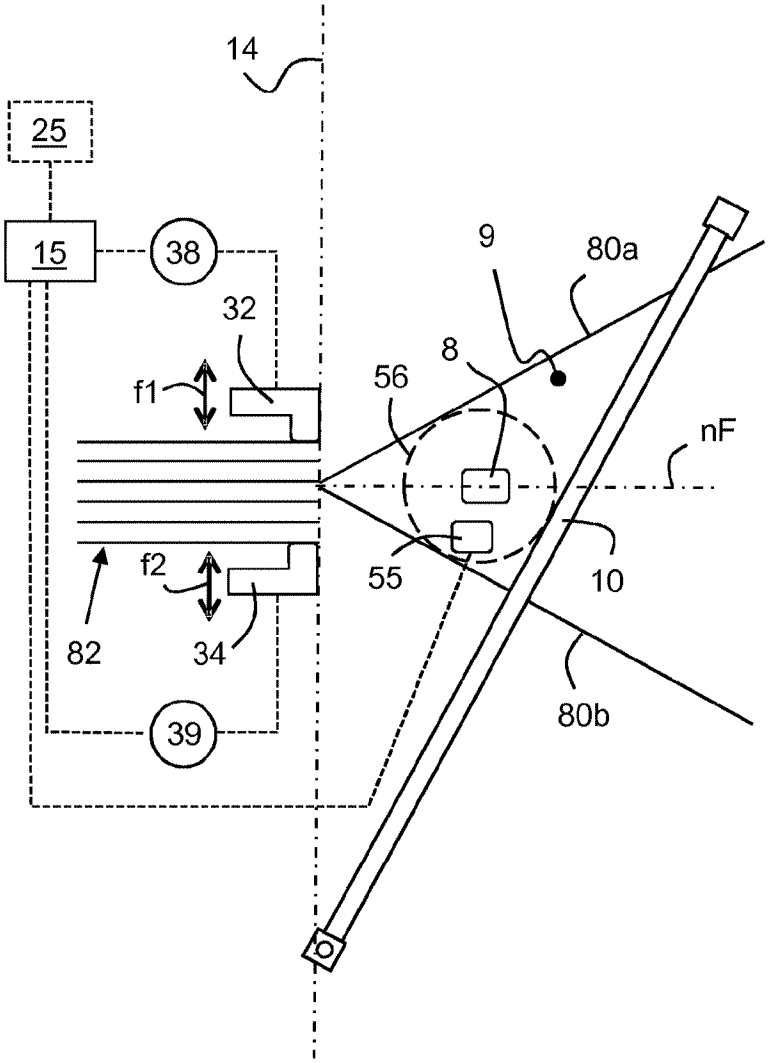
Figure 14:
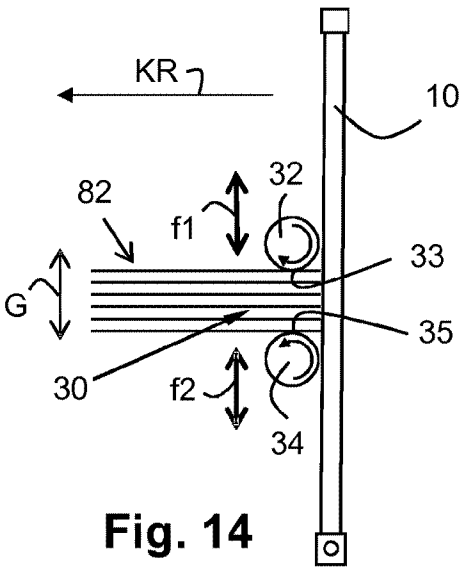
Figure 15:
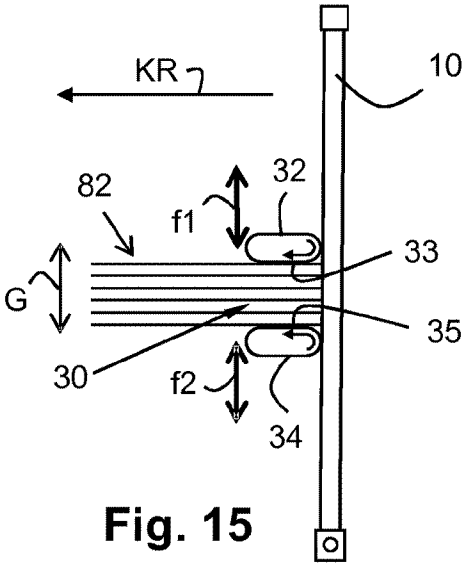
Figure 13:
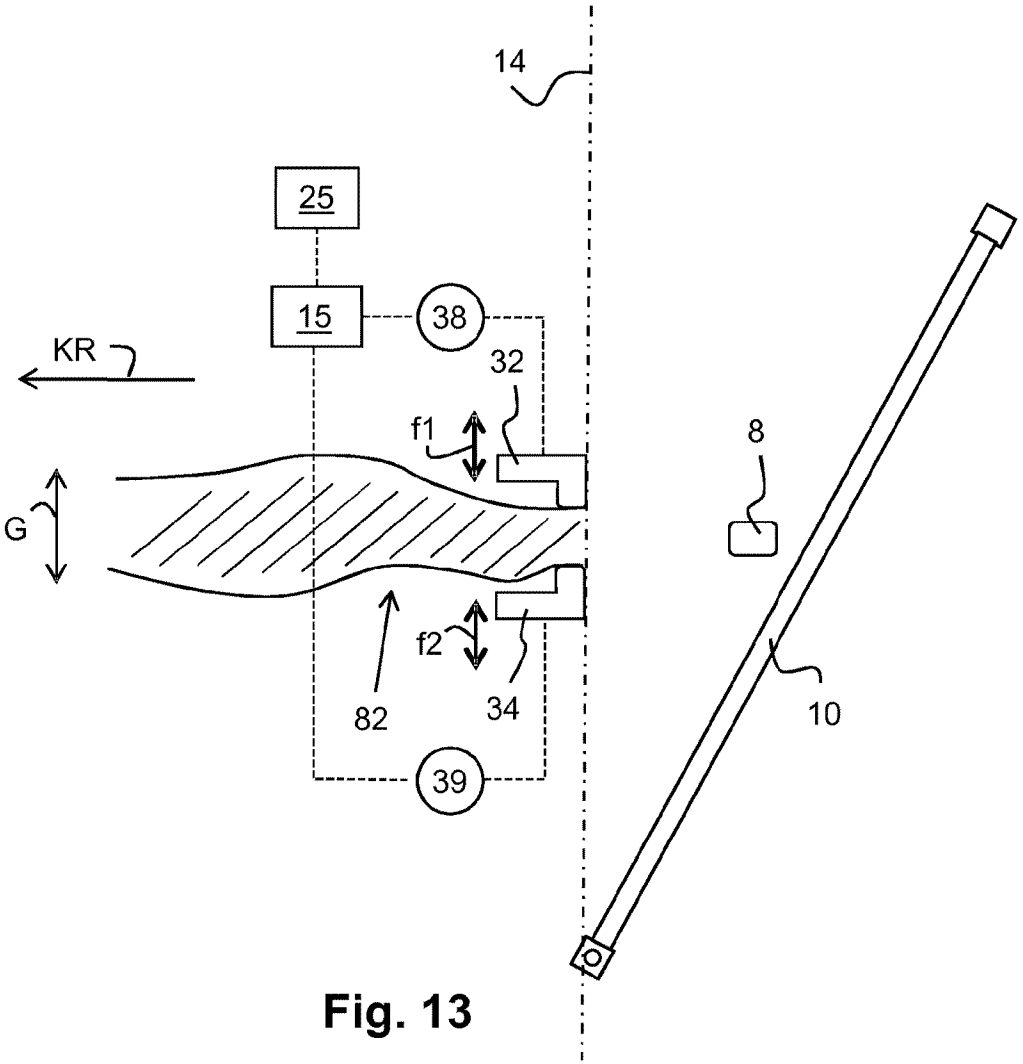
Figure 17:
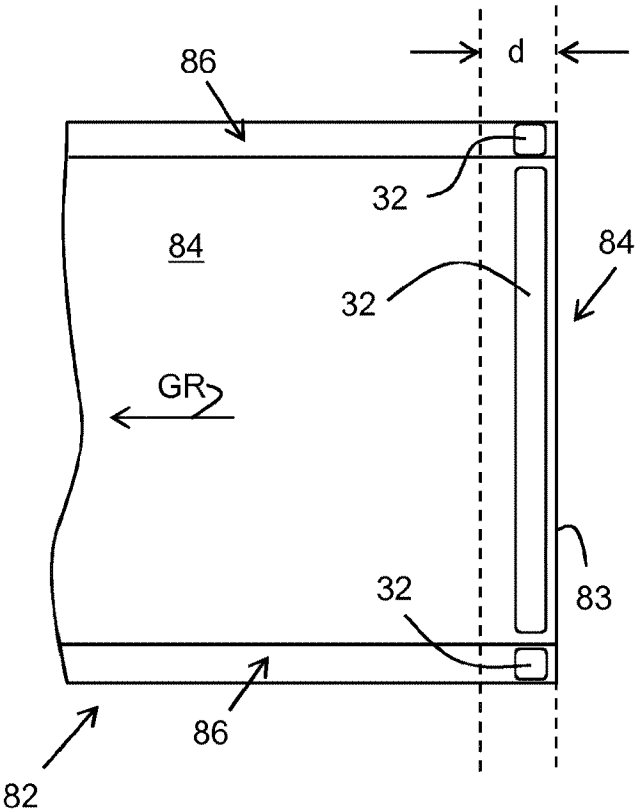
Figure 16:
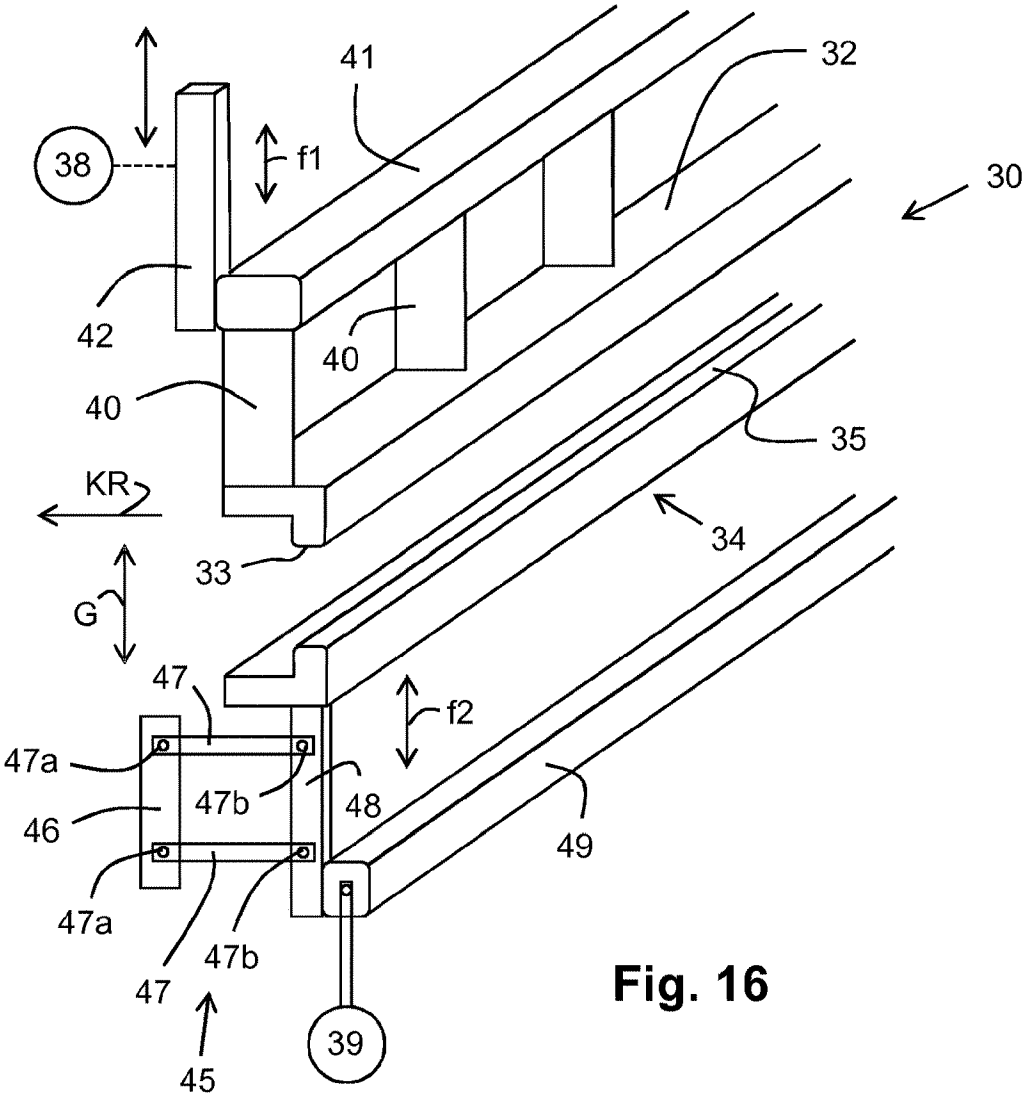

In the following, the invention is explained in further detail in connection with drawings. The figures are to be considered simply as example embodiments, wherein individual features can also be combined with other embodiments. The same reference characters designate the same elements or elements with the same effects. It is shown by:

FIG. 1 a schematic side view of essential parts of a weaving machine;

FIG. 2 a schematic side view of a part of a first embodiment of a weaving machine in the area of the weaving reed beat-up plane with merely one guide unit (without warp threads, without woven fabric);

FIG. 3 a schematic side view of a part of a second embodiment of a weaving machine in the area of the weaving reed beat-up plane with two guide units (without warp threads, without woven fabric);

FIG. 4 the schematic side view according to FIG. 3, now with warp threads and woven fabric;

FIG. 5 the schematic side view according to FIG. 4, with lowered woven fabric;

FIGS. 6-9 four alternatives for the provision of informations for the control unit;

FIG. 10 a schematic side view of a part of a weaving machine with a sensor for analysis of the woven fabric surface;

FIG. 11 a schematic side view of a part of a weaving machine with a sensor for analysis of the open loom shed;

FIG. 12 a schematic side view of a part of a weaving machine with a spring-loaded lower guide unit;

FIG. 13 a schematic side view of a part of a weaving machine with a woven fabric with thickness variations in the warp direction;

FIG. 14 a schematic side view of a part of a weaving machine with height-movable or height-drivable rollers as guide units;

FIG. 15 a schematic side view of a part of a weaving machine with height-movable or height-drivable, continuous circulating bands or belts as guide units;

FIG. 16 a perspective view of a guide device;

FIG. 17 a top plan view onto a woven fabric with various guide devices, and

FIGS. 18-22 various embodiments of guide units in longitudinal section (section in the weft direction).

FIG. 1 shows a schematic side view of a possible embodiment of a weaving machine 1. A plurality of warp threads 80 extending next to one another is supplied for example from a warp beam 2 (alternatively from a creel), and is guidingly supplied in the warp direction KR (see arrow) over a backrest roller or whip roll 3, as well as after passing a warp stop-motion 4, to a shed-forming device 5, of which the shed forming means preferably are formed of heddles 6 which are movable opposite one another and oscillate in a known manner, in order to open or to close a loom shed 9. According to a preferred embodiment, the shed forming device 5 is of the Jacquard type.

A weft insertion device 7 (merely indicated) comprises a weft insertion means 8, which here is embodied as a thread gripper and transports weft threads through the open loom shed 9. Furthermore, the weaving machine 1 comprises a weaving reed 10, by means of which an inserted weft thread can be beat-up against the so-called interlacing point 11 of the already-produced woven fabric 82. For this purpose, the weaving reed 10 is supported rotatably about an axis 10*a*. The finished woven fabric 82 is drawn off, for example—especially for thicker woven fabrics—horizontally, by means of a drawing-off or take-off device 12, which is merely schematically indicated, or alternatively for being wound or rolled-up on a cloth beam (not shown).

A control unit 15 is connected with various drives and controls these. In this regard, a drive 16 is connected with the warp beam 2, a drive 17 is connected with the shed forming device 5, a drive 18 is connected with the weaving reed 10, and a further drive 19 is connected with the drawing-off device 12. This drive concept is selected merely as an example, other concepts are possible without further ado. The control unit 15 further acquires sensor data, here indicated for the warp stop-motion 4, in order to ensure the trouble-free operation of the weaving machine 1. In that regard, the mentioned apparatuses are connected with the control unit 15 by means of signal-transmitting lines or cables, as is indicated by the dotted lines.

The present invention relates to a guidance of the woven fabric 82 by means of one or more guide devices in the area of the weaving reed beat-up plane. The shed forming device 5 as described and shown in FIG. 1, the weft insertion device 7 with the weft insertion means 8, the weaving reed 10 as well as the drawing-off device 12 are also present in the weaving machine or weaving machines 1 according to the invention.

FIG. 2 shows a guide device 30, which encompasses a lower guide unit 34 that is L-shaped in cross-section, which comprises a guide section 35 for contacting the bottom surface of a woven fabric. Thereby, the lower guide section 34 guides the woven fabric in the immediate vicinity of the weaving reed beat-up plane 14, that is to say in the plane of the beat-up of the weaving reed 10 (illustrated in FIG. 2 with continuous solid strokes or lines in the open shed position and with dashed lines during the beat-up against the fabric edge; in several figures the beat-up weaving reed 10 is illustrated in dashed lines, and not in others, in order to make the weaving reed beat-up plane 14 more clearly recognizable). Optionally and illustrated with dashed lines, an upper guide unit 32 which is L-shaped in cross-section, with a guide section 33 is present, which is embodied rigid and immovable in the present example. If present, the upper guide unit 32 serves for the guidance of the top surface of the woven fabric.

The lower guide unit 34 is connected with a drive 39, which is connected with the control unit 15, which actuates the drive 39 in such a manner so that the lower guide unit 34 is driven in the arrow direction f2, that is to say in the woven fabric thickness direction, in order to thereby guide the woven fabric from its bottom surface. It is of course also possible (not illustrated), that an upper guide unit 32 is driven in the woven fabric thickness direction G by a drive connected with the control unit 15, whereby optionally for example a rigid lower guide unit 34 can be present.

In FIG. 3 a guide device 30 is illustrated, which in the present case encompasses two guide units 32, 34 lying above one another. The upper guide unit 32 is positioned above a woven fabric (not illustrated in FIG. 3), while the lower guide unit 34 is arranged below the woven fabric. In the illustrated example embodiment, which is not to be interpreted in a limiting or constraining manner, both guide units 32, 34 are embodied L-shaped in the cross-section, whereby each one of the guide units 32, 34 comprises two guide sections 33 or 35 facing toward one another, which for the contacting with the woven fabric in the immediate or direct vicinity of the weaving reed beat-up plane 14. The weaving reed beat-up plane 14 is that plane at which the weaving reed 10 beats-up against the woven fabric 82 after the insertion of a weft thread.

Both guide units 32, 34 are furthermore connected with a drive 38 or 39, which in turn are connected with the control unit 15. The control unit 15 actuates the two drives 38, 39 in such a manner so that these can be driven the guide units 32, 34 toward one another or in opposite directions as well as in the respective same direction, as this is indicated by the respective arrows f1 and f2 (corresponding to the above described second aspect of the invention). With woven fabric 82 clamped in place (see FIG. 4), this is the woven fabric thickness direction G, which extends parallel to the weaving reed beat-up plane 14.

The upper and/or the lower guide units 32, 34 preferably extend in the weft direction over the entire woven fabric width. Alternatively, an extension over only a part of the woven fabric is also possible. Also, several upper and/or lower guide units 32, 34 extending next to one another in the weft direction can be realized.

In FIG. 3 a spacing distance d is illustrated not-to-scale, measured from the weaving reed beat-up plane 14 in the direction of the woven fabric lengthwise direction GR (here extending parallel to the warp direction KR). This spacing distance d indicates the preferred area or region in which the guide units 32, 34 guide the woven fabric 82 in a contacting manner, wherein the stated guidance does not need to take place over the entire area or region, but rather can lie within this area or region. The area with the spacing distance d from the weaving reed beat-up plane 14 extends preferably 0 to 100 mm, especially preferably between 0 to 50 mm, in the woven fabric lengthwise direction GR.

In FIG. 4, the same cut-out section of the weaving machine 1 is illustrated as in FIG. 3, but this time with warp threads 80*a*, and woven fabric 82. In the case illustrated here, the woven fabric is relatively thick, for example thicker than 10 mm or even thicker than 20 mm or still thicker, wherein thicknesses up to 100 mm or even more are possible. The layer-wise weaving of the weft threads is indicated by the meandering-shaped course or progression 89, wherein the loom sheds 9 in this simplest case are alternately switched from the top to the bottom or from the bottom to the top, so that the weft sequence or progression results sequentially in the vertical direction. The thus-produced woven fabric 82 is built up layer by layer.

FIG. 4 represents the state of the guide units 32, 34 in their neutral position, that is to say without the position of the guide units 32, 34 changed in the woven fabric thickness direction G. In FIG. 4, the upper layer of the woven fabric 82 is just being produced, whereby the weft insertion means 8 is being guided through the open loom shed 9. The loom shed 9 is produced by upper warp threads 80*a* and lower warp threads 80*b*, for example in the case of a shed forming device embodied as a Jacquard machine, by actuation of the actuators for the corresponding heddles. As can be seen further in FIG. 4, the position 11*a*—the use of the term "interlacing point" would be misleading here; with thicker woven fabrics it more involves an "interlacing or binding edge" that extends vertically and in the plane of the illustration in a sectional view—, which in the present case is the starting point of the warp threads 80*a*, 80*b* in the direction of the open loom shed 9, due to the relatively large thickness of the woven fabric 82 comprises a large spacing distance to the neutral shed nF which extends in the warp direction KR at the height of the weft insertion means 8. This in turn is the basis of a relatively large spacing distance a1 of the weft insertion means to the upper warp threads 80*a* or a relatively small spacing distance a2 to the lower warp threads Due to the small spacing distance a2 there is a great danger that the weft insertion means 8 will collide with the lower warp threads 80*b* during the travel through the open loom shed 9, which would lead to a stoppage of the weaving process and to damages of the woven fabric 82 as well as the supplied warp threads 80.

It is further to be mentioned that the course of the two illustrated warp threads 80*a*, 80*b* shown in FIG. 4 represents merely an example, because the two warp threads 80*a*, 80*b* do not necessarily run together in the position 11*a*. Instead, depending on the woven fabric 82, it is also possible that an upper warp thread 80*a* is beat-up against the woven fabric 82 further downward, while a lower warp thread 80*b* is beat-up above this upper warp thread 80.

According to the invention, the woven fabric 82 is shifted or displaced in the woven fabric thickness direction G by means of at least one guide unit 32, 34, so that the weft insertion means 8 can be guided in a collision-free manner through the open loom shed 9. In FIG. 4, both guide units 32, 34 are being shifted or displaced downwardly (see arrows f1, f2), so that the position 11*a* lies at essentially the height of the neutral shed nF and the spacing distances a1 and a2 to the weft insertion means 8 are essentially of the same size, as this is illustrated in FIG. 5. Thereby the weft insertion means 8 can pass through the open loom shed 9 in a collision-free manner.

Thus, in other words, when an upper (or the uppermost) layer of the woven fabric 82 is just being woven corresponding to the weave pattern design stored in the pattern draft, corresponding to the example of FIG. 4, then the woven fabric 82 is lowered with the aid of the guide units 32, 34 due to the informations corresponding thereto, which is then effectuated by the control unit 15 by actuation of the drives 38, 39 (see FIG. 5).

For the corresponding actuation of the guide units 32, 34 (according to the above described first aspect of the invention) the control unit 15 processes informations that are related to or associated with the structure of the woven fabric 82 in the area of the weaving reed beat-up plane 14. These informations for example contain the position of the warp threads that are next to be inserted into the woven fabric 82, which is especially of great importance for thicker woven fabrics, as can be seen in FIGS. 4 and 5. In these figures it is illustrated that the control unit 15 is connected with a storage unit 25, which holds ready the informations for the control unit 15, which transforms these into commands or instructions to the drives 38, 39 for positioning the guide units 32, 34 in the woven fabric thickness direction G. Specific embodiments of this arrangement are illustrated in FIGS. 6 to 9.

Figure 6:
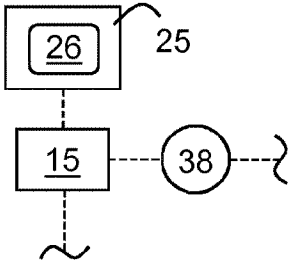

The pattern draft 26 for the woven fabric 82 is stored in the storage unit 25 according to FIG. 6. According to an embodiment, not only the weave pattern design is stored in the pattern draft 26 itself, but also additionally the stated informations, which for example include, that the layer to be woven currently is the uppermost layer in the woven fabric 82 and therefore the guide units 32, 34 is to be lowered by half of the woven fabric thickness in the woven fabric thickness direction G, in order to enable a collision-free travel of the weft insertion means 8 through the open loom shed 9. The informations can also be stored in the pattern draft 26 as direct control instructions, which are transformed by the control unit 15 into control commands for the drives 38, 39. Thereby, all of these informations are related to the momentary or current woven fabric structure at the woven fabric edge 83 or in the area of the weaving reed beat-up plane 14.

Figure 7:
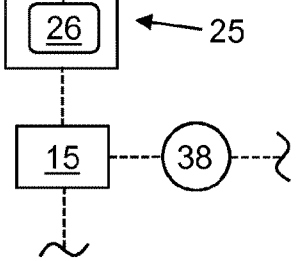

According to an alternative illustrated schematically in FIG. 7, in addition to the weave pattern design, separate informations are stored in the pattern draft that is stored in the storage unit 25, wherein these separate informations for example involve indices that refer to a data track 27 that is similarly stored in the storage unit 25, wherein the data track 27 contains the stated informations for the control unit 15 for the following actuation of the drives 38, 39. In this regard, the informations in the data track 27 are correspondingly synchronized with the instructions for the shed forming device 5 and the weft insertion device 7. Then, upon reading out the pattern draft 26, via the indices the data track 27 is read out essentially simultaneously by the control unit 15.

Figure 8:
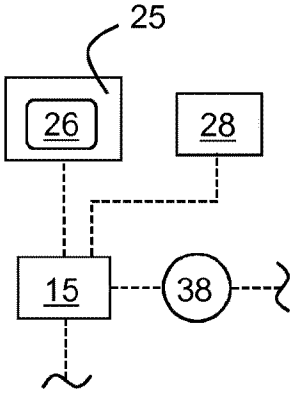

A further alternative is illustrated in FIG. 8. There, a second storage unit 28 is provided, in addition to a first storage unit 25 in which the pattern draft 26 defining the weave pattern design is stored. The informations related to the woven fabric structure in the area of the weaving reed beat-up plane 14 are stored in this second storage unit 28. The control unit 15 accesses these informations and processes them—synchronized with the actual momentary woven fabric position on the woven fabric edge 83 or on the weaving reed beat-up plane 14—for actuating the drives 38, 39 for the guide units 32, 34.

Figure 9:
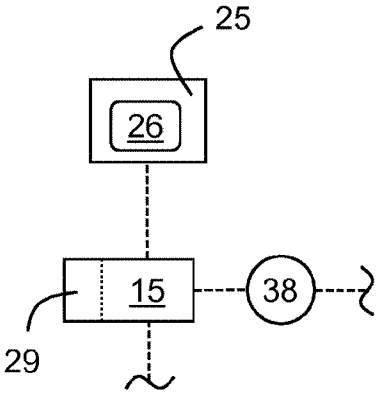

According to a further alternative, which is schematically illustrated in FIG. 9, the control instructions for the drives 38, 39 are calculated by a correspondingly embodied algorithm 29 directly from the pattern draft 26, that is to say from the electronically stored weave pattern design that is stored in the storage unit 25. Such a calculation is advantageously carried out continuously during the weaving operation, whereby the algorithm 29 is, for example, processed by the control unit 15 (as indicated in FIG. 9) or from a different—not illustrated—processor unit, which then further transfers the corresponding informations to the control unit 15. According to an alternative, the algorithm is already utilized when establishing the pattern draft 26, in order to introduce or store stated informations for actuating the drives 38, 39 into the pattern draft 26 already in advance, which are then successively called-up by the control unit 15 during the weaving operation.

In FIG. 10, an alternative according to the invention is illustrated, of how the control unit 15 receives the stated informations for actuating the drives 38, 39. In the variant shown in FIG. 10, a sensor 50 is arranged above the top surface 84 of the woven fabric 82 and is connected with the control unit 15. The sensor 50 is embodied, for example, as an ultrasonic sensor or as an optical sensor, and senses or detects the top surface of the woven fabric 82, which is indicated by the ray cone 51. Especially from the spacing distance of the top surface of the woven fabric 82 to the sensor 50, the control unit can determine whether the woven fabric 82 must be lowered or displaced upwardly by means of the guide units 32, 34 for an interference-free weaving operation.

The arrangement of the sensor 50 is merely exemplary. Alternatively or additionally, a sensor can detect or sense the bottom surface 85 of the woven fabric 82. More than one or two sensors are also possible. Again alternatively or additionally, one or more sensors can be arranged on the end face of the weaving reed 10 and/or stationarily between one or both guide devices 32, 34 and the weaving reed 10, wherein the stated at least one sensor is then arranged in front of the weaving reed beat-up plane.

An alternative for the control of the drives 38, 39 is illustrated in FIG. 11. Here, a sensor 55 is provided, which analyzes the position of the warp threads 80 (80*a*, 80*b*) in the open loom shed 9. For this purpose, the sensor 55 is preferably embodied as an optical sensor, especially preferably as a camera, which is arranged laterally from the loom shed 9 and detects the open loom shed 9 in the weft direction (thus perpendicularly to the plane of the paper), which is indicated by the area 56 detected the open loom shed 9 in the weft direction. The optical sensor analyzes the open loom shed 9 and particularly determines the position of the warp threads 80*a*, 80*b* in the loom shed 9, in order to especially recognize a possible collision of the weft insertion means 8 with the warp threads 80*a*, 80*b*. The sensor 55 transmits the measurement results or—after calculation—the analysis results to the control unit 15 (see dashed line), which then processes the results in order to actuate the drives 38, 39.

In FIG. 12, the guidance of a woven fabric 82 in the area of the weaving reed beat-up plane 14 is illustrated, wherein the upper guide unit 32 is being actively positioned by a drive 38 in the woven fabric thickness direction G, while the lower guide unit 34 passively follows along. For this, the lower guide unit 34 is, for example, impinged upon with a spring force from one or more springs 20, as schematically illustrated in FIG. 12. If the upper guide unit 32 is moved upwardly, then the spring force presses the lower guide unit 34 from below against the woven fabric 82, so that a contact always exists between lower guide unit 34 and woven fabric 82. Such an arrangement especially has the advantage of a simple construction. It is of course also possible that the lower guide unit 34 is actively positioned by means of a drive, while the upper guide unit 32 is passively guided in a following manner.

FIG. 13 shows an example in which the woven fabric 82 is woven with thickness variations in the warp direction KR, in order to satisfy special requirements for the later application of the woven fabric 82. In order that the woven fabric 82 can always be guided in the woven fabric thickness direction G in the area of the weaving reed beat-up plane 14 during the weaving process, the two guide units 32, 34 are followingly guided under constant adaptation to the respective woven fabric thickness, including the necessary counter-running or contrary motion of the two guide units 32, 34 in the woven fabric thickness direction G, effectuated by control commands from the control unit 15 to the drives 38, 39 (also see the arrows f1 and f2). But a positioning of the two guide units 32, 34 in a common direction is also possible, especially if a woven fabric structure that swings or oscillates upwards or downwards in the warp direction KR is to be woven, for example with a constant woven fabric thickness.

A counter-running or counter-direction motion of the two guide units 32, 34 relative to the woven fabric thickness direction G with a changing woven fabric thickness in the warp direction KR can also be realized by means of at least one active guide unit 32 or 34 from one woven fabric side and at least one passive, for example spring-loaded, guide unit 34 or 32 from the other woven fabric side.

The adaptational fitting of the guide units 32, 34 to the woven fabric thickness in the warp direction KR can also, without any difficulties, be combined with the shifting or displacement of the woven fabric in the area of the weaving reed beat-up plane 14 as a whole in the woven fabric thickness direction, as has especially been explained in connection with the FIGS. 4 and 5 further above.

Two alternatives to the L-shaped guide units 32 according to FIGS. 2 to 13 are illustrated in FIGS. 14 and 15. Corresponding to FIG. 14, the guide units 32 are embodied as actively driven or passive rollers (see rotation direction). According to FIG. 15, the guide units 32 are embodied as actively driven or passively circulating continuous bands or belts, which—exactly like the rollers—can also be utilized for the transport of the woven fabric 82 in the warp direction KR. The rollers and the circulating continuous belts can be positioned preferably in height, that is to say in the woven fabric thickness direction G, as this is indicated by the arrows f1 and f2. The drives and the control unit are respectively not illustrated presently.

A perspective view of a possible embodiment of a guide device 30 is illustrated in FIG. 16, which guide device encompasses an upper guide unit 32 and a lower guide unit 34. Both guide units 32, 34 are embodied as rigid profiles that are L-shaped in cross-section and that extend in the weft direction SR. The upper guide unit 32 is connected by means of vertical struts 40 with a transverse profile 41 that extends parallel to the guide unit 32, wherein the transverse profile 41 in turn is connected at its two end faces (only one is shown) with a drive profile 42, onto which the drive 38 engages in order to position the guide unit 32 in the woven fabric thickness direction G. The drive profile 42 is merely schematically illustrated and can, for example, encompass a toothed rack, into which a pinion that is driven by the drive 38 engages. The most varied embodiments are possible in order to drive or move the guide unit 32 by means of the drive 38 in the woven fabric direction.

According to the illustrated example embodiment, the lower guide unit 34 is connected via a double swivelling mechanism 45 with a stationary or fixed machine part 46. The double swivel joint comprises two swivel arms or swing levers 47 that are arranged one above another, of which one end is connected in a pivoting or swivelling manner about the swivel axes 47*a* and the other end is connected about the swivel axes 47*b* in a pivoting or swivelling manner with a vertical strut 48. In turn, the vertical strut 48 is connected, on the one hand, with the lower guide unit 34 that is L-shaped in cross-section, and on the other hand with a transverse profile 49 that extends parallel to the guide unit 34, onto which the drive 39 engages and can lower it downwardly and drive it upwardly in a controlled and defined manner (see double arrow f2) by means of the coupling with the double swivelling mechanism 45. In this regard, while the lower guide unit 34 carries out a minimal swinging or swivelling motion via the double swivel mechanism 45, which motion goes along with a motion of the guide section 35 of the lower guide unit 34 in or contrary to the warp direction KR; this is, however, insignificant in comparison to the shifting displacement in the woven fabric thickness direction.

FIG. 17 illustrates a top plan view onto a woven fabric 82 with different guide units 32, which are responsible for the guidance of the top surface 84 of the woven fabric in various different woven fabric areas or regions. The middle or center guide unit 32 is responsible for the guidance of the woven fabric region that lies between the two lateral lengthwise edges 86 (also called catch selvages) of the woven fabric 82 that extend in the warp direction (KR), wherein the guide unit 32 lies against the top surface 84 of the woven fabric 82 in the area of the woven fabric edge 83 or the weaving reed beat-up plane 14 (corresponding to the explanations according to FIGS. 2 to 16).

This part of the woven fabric 82 is also called the main woven fabric. In comparison, the two outer guide units 32 are provided for the guidance of the lengthwise edges 86 of the woven fabric 82. Such a distribution of the tasks for the guidance of the woven fabric 82 is, for example, sensible or suitable if the lateral lengthwise edges 86 of the woven fabric 82 comprise a different thickness than the main woven fabric, e.g. due to a lower number of layers. In such a case, the respective binding edge can then be individually adjusted for the respective different woven fabric regions.

Preferably, corresponding guide units are provided also on the bottom surface of the woven fabric, of which one or more guide units can be provided for the guidance of the main woven fabric and one or more other guide units can be provided for the guidance of the lateral lengthwise edges 86. The actuation of all active guide units is preferably achieved once again by means of control unit 15 and corresponding drives.

In an embodiment that is not illustrated, one upper (and/or lower) guide unit 32 for one of the lengthwise edges 86 is present, while the main woven fabric and the other lengthwise edge 86 are guided or moved by a common upper (and/or lower) guide unit 32.

A spacing distance d is sketched into FIG. 17, which—as already explained in connection with FIG. 3—defines an area or region beginning from the weaving reed beat-up plane 14 in the woven fabric lengthwise direction GR (here coinciding with the warp direction KR), in which the guide units 32 are preferably arranged.

FIGS. 18 to 22 illustrate various different embodiments of guide devices 130, 230, 330 (respectively only shown in part), which are sectioned in the weft direction SR, with guide units 132, 232, 332, which respectively comprise different profiled shapes 136, 236, 336 in their guide sections 133, 233, 333 (these configurations relate to the third aspect of the invention). As explained above, the guide sections 133, 233, 333 respectively have contact with the top surface 84 of the woven fabric 82 (not illustrated). It is understood that the profiled shapes 136, 236, 336 that are illustrated in FIGS. 18 to 22—alternatively or additionally—can also be present on the lower guide units for guiding the bottom surface 85 of the woven fabric 82. It is also possible, that a stated profiled shape 136, 236, 336 is provided on the top or bottom surface 84, 85, and planar profile sections (as in FIGS. 2 to 16) are provided on the bottom or top surface 85, 84 (with actively driven or passive guide units). It is also possible that guide sections of the upper guide units comprise different profiled shapes than guide sections of the lower guide units.

It is common to all of the profiled shapes 136, 236, 336 that are described in greater detail in the following, that they can guide the woven fabric 82 with thicknesses that differ in the weft direction SR, so that for example no individual warp threads out of non-guided regions are lifted out of the woven fabric during the shed opening. The guide units 132, 232, 332 of FIGS. 18 to 22 preferably extend in the weft direction over the entire woven fabric width. Alternatively, an extension over only a part of the woven fabric is also possible. Several guide units 132, 232, 332 extending next to one another in the weft direction are also realizable (alternatively and/or additionally also corresponding profiled-embodied lower guide units for guiding the woven fabric on its bottom surface).

Figure 18:
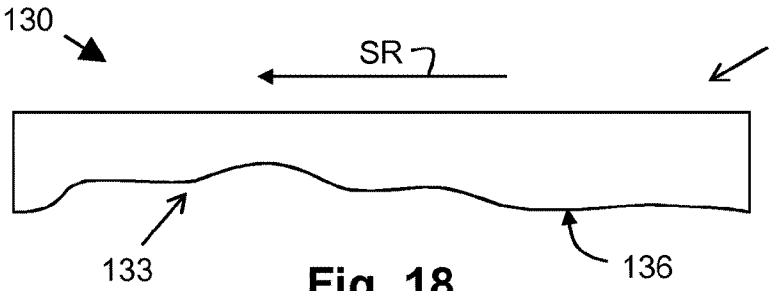

According to FIG. 18, the profiled shape 136 of the guide section 133 of the guide unit 132 is embodied continuous in the weft direction SR and is adapted or fitted to a corresponding surface profile of the top surface 84 of a woven fabric 82. The guide unit 132 can be embodied rigidly, or for example as a roller which is then embodied preferably symmetrically about a rotation axis extending in the weft direction.

Figure 19:
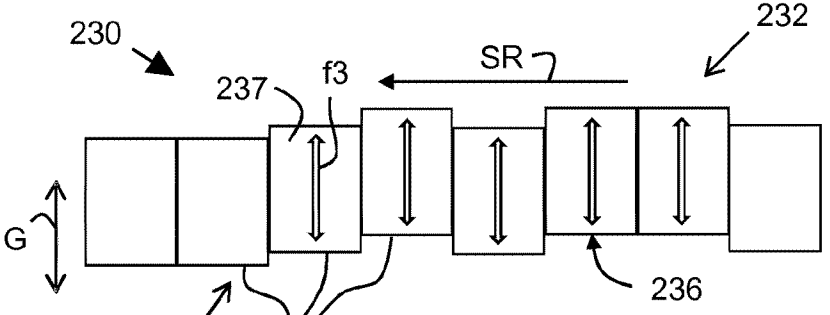

The example embodiment of FIG. 19 is characterized in that the profiled shape 236 of the guide unit 232 comprises individual actuators 237 arranged behind one another in the weft direction SR, with respective allocated guide partial sections 233*a*, which all together form the guide section 233. The individual actuators 237 and therewith also the guide partial sections 233*a* are separately adjustable in the woven fabric thickness direction G by means of the (non-illustrated control unit 15), in order to be able to react, especially during the weaving operation, to thickness fluctuations of the woven fabric 82 in the weft direction SR specified in the weave pattern design, and thereby to always ensure an optimal woven fabric guidance.

Figure 20:
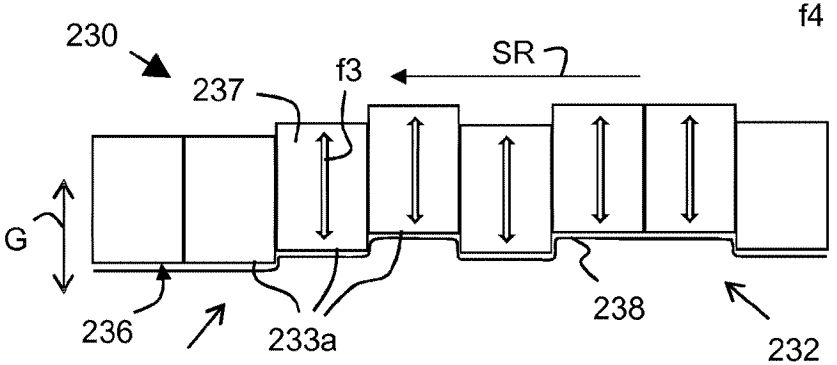

The embodiment according to the in the FIG. 20 is distinguished from that of FIG. 19 merely in that the guide partial sections 233*a* are covered with a flexible sheath 238, which cover the transitions between the guide partial sections 233*a* and thereby gently or protectively handle the woven fabric 82 during the contacting.

Figure 21:
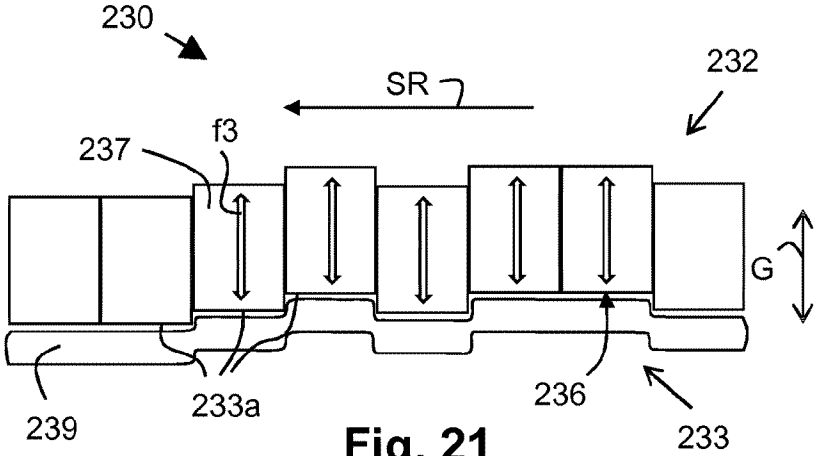

The embodiment of FIG. 21 in turn is distinguished from that of FIGS. 19 and 21 in that an elastic element 239 is arranged on the guide section 233, here embodied as a hose impinged with compressed air. In the illustration according to FIG. 21, the lower contour of the hose is illustrated in a state in which it is in contact with a correspondingly contoured woven fabric 82 (not illustrated).

Figure 22:
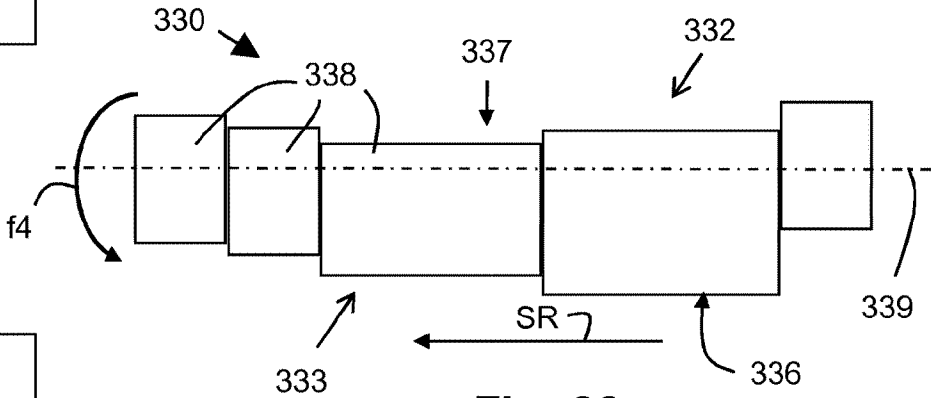

Finally in FIG. 22, the profiled shape 336 of the guide unit 332 is realized by a roller 337, which is supported to be rotatable about a rotation axis 339 extending parallel to the weft direction SR, and is preferably actively set into a rotating motion (see arrow f4). The roller 337 comprises several segments 338 arranged behind one another in the weft direction SR, which here partially comprise a different diameter and additionally are at least partially arranged eccentrically relative to the rotation axis 339.

Positions or layers of the formed loom sheds 9 that deviate in the weft direction can also be equalized or evened-out with respect to the woven fabric thickness with the aid of segmented profiled shapes, as they have been described in an exemplary manner in connection with the explanations according to FIGS. 18 to 22. An example here are those already mentioned above on the lateral lengthwise edges 86 of the woven fabric 82 as well as the main woven fabric between these two lateral lengthwise edges 86. Through a suitable profiled shape—for example with a through-going continuous profiled shape 136 corresponding to FIG. 18 or by means of actuators 237 according to FIGS. 19 to 21—a secure or reliable woven fabric guidance can also be realized even with such thickness variations.

The example embodiments illustrated in the figures can be combined in various different ways. Thus, for example, the guide units 132, 232, 332 of FIGS. 18 to 22, which clarify the third aspect of the invention in an exemplary manner, can be combined with a control unit 15 as illustrated in FIGS. 1 to 17 and the n remaining devices associated therewith, which are embodied corresponding to the first and/or the second aspect of the invention.

REFERENCE CHARACTER LIST

1 weaving machine or loom
2 warp beam
3 back rest roller or whip roll
4 warp stop-motion
5 shed forming device
6 heddles
7 weft insertion device
8 weft insertion means
9 loom shed
10 weaving reed
10*a* rotation axis
11 interlacing point
11*a* position
12 drawing-off or take-off device
14 weaving reed beat-up plane
15 control unit
16 drive
17 drive
18 drive
19 drive
20 spring
25 storage unit
26 pattern draft
27 data track
28 second storage unit
29 algorithm
30 guide device
32 guide unit
33 guide section
34 guide unit
35 guide section
38 drive
39 drive
40 vertical struts
41 cross or transverse profile
42 drive profile
45 double swiveling mechanism
46 stationary machine part
47 swivel arms or swing levers
47*a* swivel or swing axes
47*b* swivel or swing axes
48 vertical struts
49 cross or transverse profile
50 sensor
51 ray cone
55 sensor
56 detected area
80 warp thread
80*a* upper warp thread
80*b* lower warp thread
82 woven fabric
83 woven fabric edge
84 top surface of the woven fabric
85 bottom surface of the woven fabric
86 lateral lengthwise edges of the woven fabric
89 meandering course or progression
130 guide device
132 guide unit
133 guide section
136 profiled shape
230 guide device
232 guide unit
233 guide section
233*a* guide partial section
236 profiled shape
237 actuators
238 sheath
239 elastic element
330 guide device
332 guide unit
333 guide section
336 profiled shape
337 roll or roller
338 segments
339 rotation axis
G woven fabric thickness direction
f1-f4 motion directions
nF neutral shed
KR warp direction
SR weft direction
GR woven fabric lengthwise direction
a1,a2 spacing distances
d spacing distance

The invention claimed is:

1. A weaving machine, comprising:

a shed forming device that opens and closes a loom shed formed by a plurality of warp threads of a fabric being woven by the weaving machine;

a weft insertion device that inserts weft threads through the open loom shed;

a weaving reed that beats up the weft threads at a beat up plane against an edge of the woven fabric;

a drawing off device that draws off the woven fabric;

a guide device comprising at least one guide unit that extends at least partially over a width of the woven fabric, the guide unit driven by a drive and comprising a guide section that is positionable in a direction of thickness of the woven fabric to contact and guide the woven fabric in an area of the beat up plane, the guide unit being one or both of an upper guide unit that contacts a top surface of the woven fabric or a lower guide unit that contacts a bottom surface of the woven fabric; and a control unit in communication with the drive, the control unit configured to control movement of the guide unit in alternate directions along the direction of thickness of the woven fabric as the fabric is being woven in synch with continuous alternating vertical movement of a weaving location along an edge of the fabric where the warp threads are woven into the fabric such that the weft insertion device is positioned in the open loom shed prior to weft insertion so as to be guided through the open loom shed in a collision free manner relative to the warp threads, wherein the control unit controls the movement of the guide unit in the alternate directions based on information related to one or both of a structure of the woven fabric in the area of the beat up plane or a position of the warp threads in the open loom shed.

2. The weaving machine according to claim 1, wherein the control unit acquires the information related to the structure of the woven fabric structure in the area of the beat up plane from one or more of the following sources:

a weave pattern draft stored in a first storage unit that is accessed by the control unit wherein the information is incorporated into the weave pattern draft;

a second storage unit in which the information is stored and that is accessed by the control unit, wherein the control unit also accesses a weave pattern draft stored in a first storage unit;

a control algorithm process that produces the information from a weave pattern draft that is stored in a first storage unit during the weaving operation; and one or more sensors in communication with the control unit and positioned to analyze a surface of the woven fabric, the sensors located at one or more of: in front of the beat up plane, stationary between the guide unit and the weaving reed; below the woven fabric adjacent the beat up plane; and above the woven fabric adjacent the beat up plane.

3. The weaving machine according to claim 1, wherein one or more sensors is configured to analyze the position of the warp threads in the open loom shed, wherein results of the analysis are information processed by the control unit to control the drive.

4. The weaving machine according to claim 1, wherein the control unit is configured to actuate the drive based on the information so that the woven fabric as a whole is displaced in the area of the beat up plane in the direction of the woven fabric thickness.

5. The weaving machine according to claim 1, wherein the control unit is configured to actuate the drive based on the information so that the top or bottom surface of the woven fabric contacted by the guide unit in the area of the beat up plane is displaced in the direction of the woven fabric thickness in order to guide the weft insertion device through the loom shed in a collision free manner relative to the warp threads.

6. The weaving machine according to claim 1, wherein both of the upper and lower guide units are driven by a respective drive such that both of the guide sections are movable in the same or opposite directions along the thickness of the woven fabric.

7. The weaving machine according to claim 1, wherein the upper and lower guide units are controlled according to one or more of:

the guide section of the respective upper and lower guide units move in a same direction along the direction of thickness of the woven fabric;

the guide section of the respective upper and lower guide units move in an opposite direction along the direction of thickness of the woven fabric;

the guide section of one of the guide units moves along the direction of thickness of the woven fabric and the guide section of the other guide unit remains stationary; and the guide section of one of the guide units is driven along the direction of thickness of the woven fabric and the guide section or the other guide unit moves passively along the direction of thickness of the woven fabric.

8. The weaving machine according to claim 1, wherein at least one of the guide units is configured as one of: a rigid profile member extending in the weft direction; a passive or actively driven roller; or a circulating continuous belt.

9. The weaving machine according to claim 1, wherein one of the guide units is arranged in an area of a lateral lengthwise edges of the woven fabric extending in a warp direction or in an area of the woven fabric adjoining the lengthwise edge toward a center of the woven fabric.

10. The weaving machine according to claim 1, wherein the guide section of the respective upper and lower guide units contacts the surface of the woven fabric within an area having a spacing distance of 0 mm to 100 mm measured from the beat up plane in a lengthwise direction of the woven fabric.

11. The weaving machine according to claim 1, wherein the upper and lower guide units are controlled according to one or more of:

the woven fabric is contacted in the area of the beat up plane only from the top surface;

the woven fabric is contacted in the area of the beat up plane only from the bottom surface; or the woven fabric is contacted in the area of the beat up plane from the top and the bottom surface.

12. A method for guiding a woven fabric in a weaving machine, comprising:

as the fabric is being woven, guiding the woven fabric on one or both of a top surface of the woven fabric and a bottom surface of the woven fabric with at least one guide device, the guide device including one or both of an upper guide unit with a guide section that contacts the upper surface of the woven fabric and a lower guide unit with a guide section that contacts a bottom surface of the woven fabric, the upper and lower guide units extending at least partially over a width of the woven fabric, one or both of the upper and lower guide units movable in alternate directions along a direction of thickness of the woven fabric to contact and guide the woven fabric in an area of a beat up plane where a weaving reed beats up weft threads at against an edge of the woven fabric; and with a control unit, controlling a respective drive configured with one or both of the guide units as the fabric is being woven to move the respective guide section in alternate directions along the thickness of the woven fabric in synch with continuous alternating vertical movement of a weaving location along an edge of the fabric where the warp threads are woven into the fabric such that the weft insertion device is positioned in the open loom shed prior to weft insertion so as to be guided through the open loom shed in a collision free manner relative to the warp threads, wherein the control unit controls the movement of the guide unit in the alternate directions based on information provided to the control unit related to one or both of a structure of the woven fabric in the area of the beat up plane or a position of warp threads in an open loom shed formed by a plurality of warp threads of the fabric being woven by the weaving machine.

13. The method according to claim 12, wherein the control unit acquires the information to control the respective drive from one or more of the following sources:

a weave pattern draft stored in a first storage unit that is accessed by the control unit, wherein the information is incorporated into the weave pattern draft;

a second storage unit that is accessed by the control unit, wherein the control unit also accesses a weave pattern stored in a first storage unit;

a control algorithm process that produces the information from a weave pattern draft that is stored in a first storage unit during the weaving operation;

one or more sensors located to analyze a top or bottom surface of the woven fabric in front of the beat up plane; and one or more sensors located to analyze the position of the warp threads in the open loom shed.

14. The method according to claim 12, wherein the control unit actuates the respective drive configured with one or both of the guide units based on the information so that the woven fabric as a whole is displaced in the area of the beat up plane in the direction of the woven fabric thickness in order to guide a weft insertion device through the loom shed in a collision free manner relative to the warp threads.

15. The method according to claim 12, wherein the control unit actuates the respective drive configured with one or both of the guide units based on the information so that the surface of the woven fabric contacted by the guide unit in the area of the beat up plane is displaced in the direction of the woven fabric thickness in order to guide a weft insertion device through the loom shed in a collision free manner relative to the warp threads.

16. The method according to claim 12, wherein the guide device includes the upper guide unit and the lower guide unit, the control unit actuating the respective drives so that the respective guide section of the upper and lower guide units move in a same direction along the direction of thickness of the woven fabric or the respective guide section of the upper and lower guide units move in an opposite direction along the direction of thickness of the woven fabric.

* * * * *